United States Patent [19]

Carey

[11] Patent Number: 4,651,493

[45] Date of Patent: Mar. 24, 1987

[54] WALL/ROOF ASSEMBLIES

[75] Inventor: Francis B. Carey, Wolverhampton, United Kingdom

[73] Assignee: Ash & Lacy PLC., Great Britain

[21] Appl. No.: 580,951

[22] Filed: Feb. 16, 1984

[30] Foreign Application Priority Data

May 11, 1983 [GB] United Kingdom ..... 8379626

[51] Int. Cl.[4] ..... E04B 7/00; E04B 2/28; E04C 2/32

[52] U.S. Cl. ..... 52/710; 52/22; 52/409; 52/478

[58] Field of Search ..... 52/562, 22, 478, 710, 52/481, 408, 409, 410, 508, 714, 715, 402, 407, 90; 24/297, 295, 291

[56] References Cited

U.S. PATENT DOCUMENTS

| | | | |
|---|---|---|---|
| 2,129,975 | 9/1938 | Urbain | 52/489 |
| 2,129,976 | 9/1938 | Urbain | 52/715 |
| 2,591,361 | 4/1952 | Knott | 52/714 |
| 2,857,995 | 10/1958 | Boulton | 52/394 |
| 2,900,677 | 8/1959 | Yetter | 52/489 |
| 3,029,561 | 4/1962 | Clay | 52/410 |
| 3,037,590 | 6/1962 | Paulecka | 52/481 |
| 3,300,934 | 1/1967 | Waizenhofer | 52/480 |
| 3,394,519 | 7/1968 | Tischuk | 52/478 |
| 3,577,694 | 5/1971 | Omholt | 52/489 |
| 3,589,525 | 6/1971 | Allen | 52/710 |
| 4,044,517 | 8/1977 | Schroter | 52/489 |
| 4,047,346 | 9/1977 | Alderman | 52/90 |
| 4,075,806 | 2/1978 | Alderman | 52/407 |
| 4,081,938 | 4/1978 | Bertacchi | 52/410 |
| 4,263,952 | 4/1981 | Kowalski | 52/710 |

*Primary Examiner*—John E. Murtagh

*Attorney, Agent, or Firm*—Kenway & Jenney

[57] ABSTRACT

A bracket assembly, for use in spacing apart the inner and outer membranes of a cavity wall or roof construction, consists of a support member attached to an inner lining membrane and having a C-shaped cross-section and a bracket element formed from a trapezoidal shaped metal plate. The bracket element has the longer parallel side bent through 90° for attachment through the outer membrane to a building structural member. Two inwardly directed slots are formed parallel to the opposite side to form a T-shaped head to the bracket for engagement with the C-section member through a twisting and locking action.

5 Claims, 6 Drawing Figures

Figure 6:
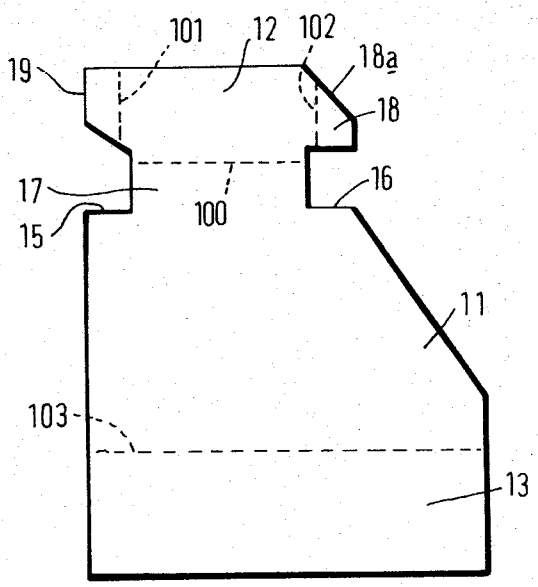

FIG. 1.
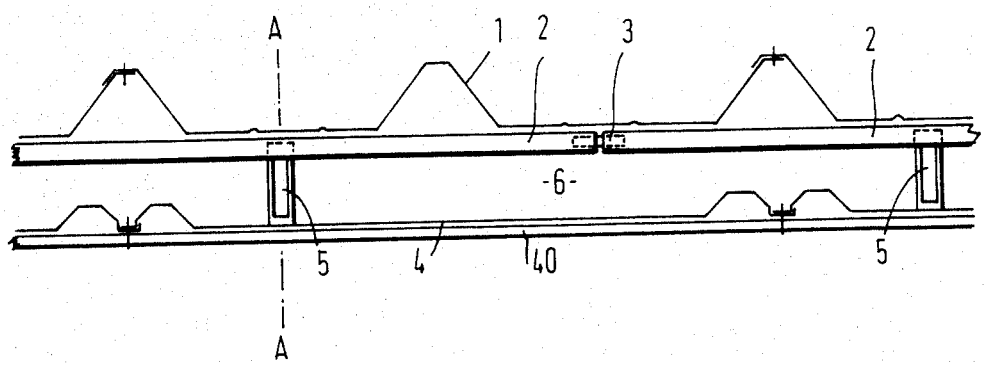
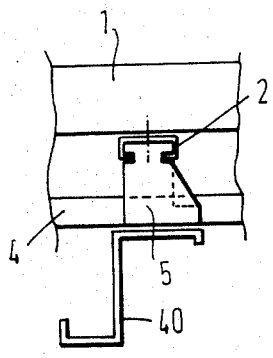
FIG. 3.
FIG. 2.
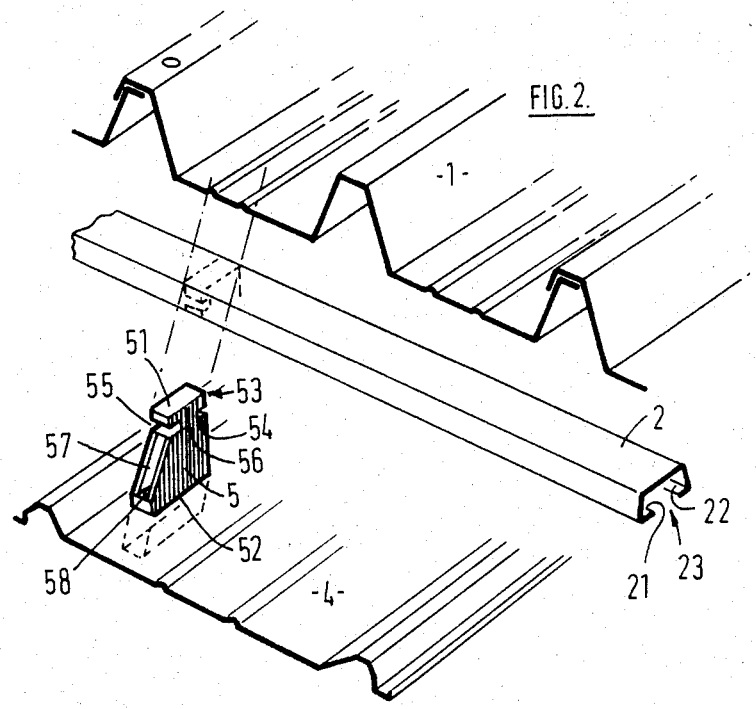

WALL/ROOF ASSEMBLIES

The present invention relates to a wall/roof assembly comprising an outer impermeable membrane and an inner lining membrane supported apart to provide a cavity therebetween and is especially concerned with the bracket assembly supporting one of the membranes.

It is well known that cavity walls provide insulation against heat loss and the loss can be further reduced by filling the cavity with an insulating material.

In the past it has been common to insulate a wall comprising an outer impermeable membrane, generally referred to as cladding, eg corrugated metal sheeting, by lining with an inner layer of insulating material such as plasterboard. More recently however it has become accepted practice to provide an inner membrane skin of suitable metal sheeting spaced apart from the outer membrane to provide a cavity that may be filled with an insulating material such as glass fibre padding. Generally the method of supporting the inner skin membrane has involved the use of Z-section members secured to and between the two membranes.

We have now improved the method of securing the inner and outer membranes together by providing a form of bracket assembly that is convenient to use is readily adaptable to different cavity sizes and has reduced heat loss through contact between the bracket and the two membranes.

From one aspect, therefore, the present invention provides a bracket assembly comprising, a rigid elongate essentially C-section member to which one of the inner or outer membranes may be secured forming a cavity wall or roof construction and a bracket element having a first portion releasably engagable between the jaws of the C-section member and a second portion for attachment to the other of the said membranes. Preferably engagement between the bracket element and the C-section member is through a material having low coefficient of heat transfer whereby heat losses are reduced.

From a further aspect the invention provides a cavity wall or roof construction comprising; a first outer impermeable membrane and a second inner lining membrane, an essentially C-section member secured to one of said first or second membranes and a bracket element having a first portion releasably engaged between the jaws of the said C-section member and a second portion contacting the other of said membranes.

In a preferred construction the said other membrane will be secured to a building, including a roof, structural member and the said bracket element will be secured to the structural member by fastening means, eg self tapping screws, extending through the said other membrane.

The bracket may comprise a T-section element the cross head of which engages with the C-section member through a twist and lock action.

In such an arrangement the bracket element may be in the form of a block, for example wood, plastic, metal or other rigid material, including, adjacent one face, two oppositely directed slots formed in opposite sides of the said block, the portion between the slots forming the stem of the T-section and the said face the cross head. The opposite face of the block being capable of attachment to one of the inner and outer membranes of the wall or roof construction.

In another arrangement the bracket element may comprise a plate having a trapezoidal shape in which the larger of the parallel sides has a portion at right angles to the plane of the plate for attachment to one of the inner or outer membranes and oppositely directed slots formed in the non-parallel sides of the plate parallel to and adjacent the smaller of the parallel sides thereof, whereby a T-section portion is provided.

The said oppositely directed slots are preferably inwardly tapered to provide an easy "lead in" action when engaging with the rigid member and a firm "locked in" position when fully engaged.

In such an arrangement the stem portion of the plate may be bent through 90° along a line adjacent and parallel to the cross head, and the end portions of the said cross head bent downwardly towards the lower edge of the said slots whereby tight engagement with the C-section member may be obtained. It is preferable that in this construction one forward and one rearward facing corner of the cross head be chamfered to facilitate the twisting and locking action.

In all such arrangements it is preferred that the portion of the bracket element engaging the C-section member be covered with an insulating cap, for example polypropylene or other resilient material, and it is further preferred that such material be substantially heat resistant. Improved grip between the bracket element cap and the C-section may be achieved by ribbing the surface of the said insulating cap.

In all constructions it is important that the slots and the T-section portion of the bracket element be dimensioned to provide a locking engagement with the C-section member.

The C-section member preferably includes a spigot extending from one end for engagement in the free end of an adjacent member whereby a continuous length of the supporting member may be provided.

Figure 5:
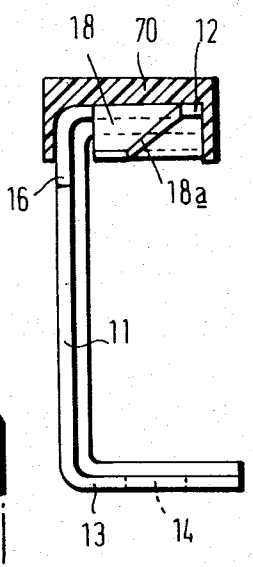
Figure 4:
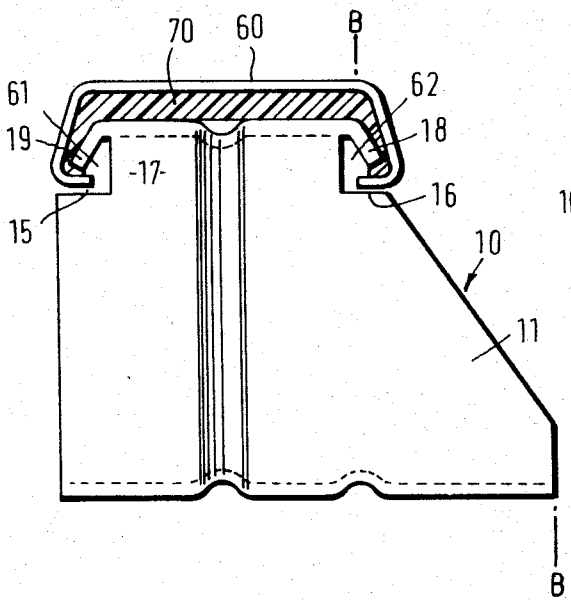

Embodiments of the invention will now be described with reference to the accompanying drawings which are diagrammatic only and in which:

FIG. 1 is a section through a cavity wall assembly of the present invention, FIG. 2 is an exploded view of a section shown in FIG. 1, FIG. 3 is a section along A—A of the FIG. 1, FIG. 4 is a side elevation of an alternative form of bracket assembly according to the present invention, FIG. 5 is a section through B—B of FIG. 4 and FIG. 6 is a representation of a flat plate from which the bracket of FIG. 4 may be formed.

Referring to FIGS. 1–3 of the drawings; outer cladding membrane 1 comprises a series of overlapping corrugated steel panels which are joined together in a conventional manner. A C-section elongate supporting member comprises a series of elements 2 joined end to end through spigot arrangements 3. The outer cladding membrane 1 is secured to the elements by the use of self tapping screws which are located beneath the corrugations in membrane 1, thereby permitting the support member 2 to lie flat against the level portions thereof.

Support member 2 is generally rectangular in section and includes inward facing jaws 21 and 22. Slot 23, formed between the jaws, faces away from outer membrane 1.

A lining membrane 4, comprises a series of thin metal sheet panels having overlapping end portions and is spaced apart from outer membrane 1 by bracket elements 5 to provide a cavity 6, between the membranes Lining membrane 4 is attached to the outer side of a building structural member 40 shown in cross-section in FIG. 3.

The bracket elements 5 are formed from a block of rigid, heat resistant plastics material having parallel top and bottom faces 51 and 52. A T-section portion 53 is formed by providing opposed slots 54 and 55 in opposite sides of the block and parallel to face 51. The portion 56 between slots 54 and 55 providing the stem portion of the T-section. Sloping side portion 57, between slot 55 and bottom face 52, is hollow and a hole 58 is formed in bottom face 52 to permit attachment of the bracket to the structural member 40 by self tapping screws which pass through the inner membrane 4.

In assembling the bracket element 5 to the C-section member element 2, the cross head of the T-section portion 53 (formed by face 51) is inserted lengthwise in slot 23 and then rotated through 90° whereby the end portions of the cross head are engaged by jaws 21 and 22 (as shown in FIG. 3) to lock the bracket element and support member element firmly together. Since bracket element 5 is formed of a plastics material an insulating cap spacing the bracket from the element, covering the T-section 53, is not required.

In view of fire regulations, it is necessary in many applications that the whole of the structure should have a high degree of resistance to heat. In such circumstances plastic materials are frequently unsuitable for use as brackets and therefore the brackets are preferably formed of metal.

One bracket/C-section member assembly is illustrated in FIGS. 4 and 5.

In the embodiment illustrated in FIGS. 4 and 5 a bracket 10 consisting of a plate having a corrugated face 11, includes parallel elements 12 and 13 extending at right angles from the top and bottom end portions of face 11. Lower element 13 contains holes 14 to enable the bracket to be attached to structural member by fastening means passing through the inner lining member 4 of a cavity wall construction.

The upper portion of face 11 is formed with inwardly extending shoulders 15 and 16 providing a central parallel sided stem 17 integral with upper element 12. Portions 18 and 19 of upper element 12 are bent outwardly beyond stem portion 17 and downwardly from each side thereof towards shoulders 15 and 16 respectively. The outward facing corner 18*a* of portion 18 is chamfered as shown in FIG. 5 and the inward corner of portion 19 (not shown) is similarly chamfered to assist in locating the said portion within jaws 61 and 62 of support member 60.

A plastic insulating cap 70 is located over and around upper element 12 such that it co-operates with element 12 and member 60 to firmly engage the bracket 10 in position (FIG. 4). Because the cap extends between the member 60 and the bracket 10, heat transfer through the bracket from the inner lining membrane is reduced.

FIG. 6 is a representation of a flat plate from which the bracket 10 of FIGS. 4 and 5 may be obtained by bending along lines 100, 101, 102 and 103. Bends 100 and 103 are made at right angles. Bends 101 and 102 are made at approximately 60°.

If the cavity between the inner and outer membranes is required to be greater than the length of the bracket then packing elements of suitable heat resisting material may be inserted between the free end of the bracket and the membrane through which it is secured or between the support member and the membrane to which it is to be secured.

I claim:

1. A bracket assembly for spacing apart a pair of membranes in a building structure comprising, in combination;

an elongate support member of sheet material attachable to one of said membranes and having a C-shaped generally rectangular cross section with a pair of inwardly facing jaws and a slot therebetween, a bracket formed from a single sheet of material comprising a plate portion having a corrugated face of sufficient length to provide a cavity of predetermined size between the membranes, and upper and lower portions respectively attachable to said support member and the other said membrane, the upper portion being formed with a pair of inwardly directed slots in opposite side edges providing a central stem and defining support member locking portions, and a cap of resilient insulating material having a support member engaging surface and being located over and round the said upper portion and positioned so that said surface firmly grips the support member when the upper portion is inserted through said slot and twisted to a position in which the said locking portions are in locking engagement with said jaws and said stem is located within said slot.

2. A bracket according to claim 1 wherein the upper and lower portion are parallel and extend at right angles from said face, the locking portions being bent outwardly beyond said stem and downwardly from each side thereof towards said slots for making locking engagement with said jaws.

3. A bracket assembly according to claim 2, in which the outwardly facing corner of one of said downwardly bent portions and the inward corner of the other of said downwardly bent portions are chamfered to facilitate the twisting and locking action.

4. A bracket assembly according to claim 2, in which the bracket comprises a plate of trapezoidal shape, the larger of the parallel sides thereof having a portion at right angles to the plane of the plate for attachment to one of said membranes.

5. A bracket assembly according to claim 1, in which the support member engaging surface is ribbed.

* * * * *